US012578149B2

(12) United States Patent
Manenti

(10) Patent No.: US 12,578,149 B2
(45) Date of Patent: Mar. 17, 2026

(54) VERTICAL VAPOR GENERATOR

(71) Applicant: Giovanni Manenti, Grumello del Monte (IT)

(72) Inventor: Giovanni Manenti, Grumello del Monte (IT)

( * ) Notice: Subject to any disclaimer, the term of this patent is extended or adjusted under 35 U.S.C. 154(b) by 268 days.

(21) Appl. No.: 18/390,519

(22) Filed: Dec. 20, 2023

(65) Prior Publication Data

US 2024/0210116 A1 Jun. 27, 2024

(51) Int. Cl.
*F28D 7/16* (2006.01)
*F28D 21/00* (2006.01)
*F28F 9/22* (2006.01)

(52) U.S. Cl.
CPC .... *F28D 7/1646* (2013.01); *F28D 2021/0064* (2013.01); *F28F 2009/222* (2013.01); *F28F 2009/226* (2013.01); *F28F 2009/228* (2013.01)

(58) Field of Classification Search
CPC ..... F28F 2009/222; F28F 2009/226; F28F 2009/228; F28D 7/1646
See application file for complete search history.

(56) References Cited

U.S. PATENT DOCUMENTS 2,363,526 A * 11/1944 Hobbs ..... F28F 9/22 285/212
2019/0360756 A1* 11/2019 Frechette ..... F28D 7/1607
2022/0055004 A1* 2/2022 Lu ..... F28F 9/24

FOREIGN PATENT DOCUMENTS

EP 2508834 A2 * 10/2012 ..... F28F 9/00

* cited by examiner

*Primary Examiner* — Devon Lane
(74) *Attorney, Agent, or Firm* — Silvia Salvadori, P.C.; Silvia Salvadori

(57) ABSTRACT

Vertical vapor generator of shell-and-tube type, for an indirect heat exchange between a tube-side fluid to be cooled and a boiling shell-side fluid, and operating method thereof. The vertical vapor generator includes shell-side baffles having a slope to promote the upward outflow of vapor from the lower surface of the baffles and the downward outflow of gravity deposits from the upper surface of the baffles. In embodiments, the vertical vapor generator mitigates or eliminates overheating and corrosion phenomena near the baffles and provides increased reliability and operating life. Operating methods are also disclosed.

15 Claims, 8 Drawing Sheets

VERTICAL VAPOR GENERATOR

BACKGROUND

Field of the Invention

The present invention refers to a shell-and-tube type vapor generator, substantially with cylindrical geometry and vertical longitudinal axis, to realize an indirect heat exchange between a tube-side fluid and a shell-side fluid. More specifically, the present invention refers to a vertical vapor generator where the shell-side fluid boils and moves upwards and where the shell-side baffles are sloped.

RELATED APPLICATIONS

The present application claims the benefit of Italian Application No. 102022000026157, filed Dec. 21, 2022, the entire contents of which are hereby incorporated by reference, the same as if set forth at length.

DISCUSSION OF THE BACKGROUND

There are numerous solutions in literature to improve the flow of shell-side fluid circulating in a shell-and-tube equipment. Several patent documents describe process equipment with tube-bundles including tilted baffles, not orthogonal to the longitudinal axis of the equipment and/or with non-flat profiles.

Patent documents No. WO2009148822, U.S. Pat. Nos. 6,827,138, 1,525,094 and 4,493,368 describe baffles, not orthogonal to the longitudinal axis of the equipment, corresponding to circular sectors and realizing a three-dimensional shell-side flow and, specifically, a helical flow.

For example, the U.S. Pat. No. 4,493,368 describes a heat exchanger where pairs of shell-side baffles are attached to a central tube and are configured to install a three-dimensional or helical flow on shell-side. Each baffle corresponds to a sloped circular sector. Each baffle of the document is delimited by radii instead of chords, where said radii are not parallel to the ground, and each baffle is not symmetric relative to at least a plane containing the longitudinal axis of the exchanger.

Patent document No. CN2672595 describes a shell-and-tube heat exchanger with straight tubes and two tube-sheets, for condensing the shell-side fluid, where the segment baffles are sloped relative to the longitudinal axis of the shell to facilitate the removal of condensate and increase the heat exchange. Baffles are elliptical segments having the chord lying on a plane not perpendicular to the longitudinal axis.

Patent document No. CN106017136, describes a vertical shell-and-tube heat exchanger, with straight tubes and two tube-sheets, where single-segment baffles are sloped relative to the ground and the related chord lies on a plane perpendicular to the longitudinal axis of the heat exchanger. However, since the paper describes a vertical condenser with condensing shell-side fluid and downwards flow, single-segment baffles have the chord facing downwards, thus corresponding to the lowest point of each baffle. Patent document No. CN106017136 does not address the problem of vertical vapor generators.

U.S. Pat. No. 4,312,303 describes a vertical shell-and-tube heat exchanger where the shell is split in a lower boiling portion (liquid-vapor portion) and an upper superheating portion (vapor portion). The boiling portion is provided with upwardly sloped baffles configured to downwardly recirculate, across the tube-bundle, the unvaporized liquid. Therefore, the baffles disclosed therein for the boiling portion are neither staggered/alternate along the longitudinal axis nor single-segmental, nor multi-segmental and nor cone and truncated cone type, and consequently the baffles are unable to install an ascending shell-side flow.

The scientific publication "Chillal et al., *Heat transfer rates in hot shell, cold tube Sloped baffled small shell, and tube heat exchanger using CFD and experimental approach*, Journal of Engg. Research, 2021, Vol. 9, No. (4B), pp. 347-358" concisely describes a shell-and-tube heat exchanger, with straight tubes and two tube-sheets, with single-segment baffles sloped in the direction of shell-side flow. However, that scientific publication does not describe in detail and unambiguously the structure of the heat exchanger, does not refer to a vertical vapor generator and refers generically to a hot shell-side liquid and a cold tube-side liquid.

In general, the literature has so far not paid much attention to the specific problem of vapor stagnation under, and fouling growth above, horizontal baffles installed in vertical vapor generators. As a result, the literature does not offer specific technological solutions.

The present invention, on the contrary, solves the problems related to horizontal baffles installed in vertical shell-and-tube vapor generators, and others, and offers a technological remedy.

The boiling of a shell-side fluid guarantees high heat exchange coefficients and therefore an efficient cooling of tube-side fluid and/or solid, of exchanging tubes and tube-sheet of the vapor generator. The high heat transfer coefficients guaranteed by the boiling of the shell-side fluid are essential when: The temperature of the tube-side fluid and/or solid is high, i.e. when the temperature may jeopardize the structural integrity of exchanging tubes and/or tube-sheet; and the tube-side fluid and/or solid, in case of poor cooling, is subjected to chemical or physical degradation, or causes corrosion of metal parts.

Transfer-line heat exchangers, installed on hydrocarbons cracking furnaces for the ethylene production, represent a major example of a vertical vapor generator of shell-and-tube type, with straight exchanging tubes, where very hot cracking gas (>800° C.) flows in the exchanging tubes and high-pressure boiling water (>5-10 MPa) flows in the shell. The exchanging tubes must be effectively cooled and the cracking gas must be rapidly cooled so that it does not chemically degrade.

Another example of a vertical shell-and-tube vapor generator, with straight exchanging tubes, with gas on tube-side at very high temperature (>750° C.) and boiling water on shell-side at high pressure (>3-4 MPa), is represented by the process boiler installed downstream of the ammonia oxidation reactor in nitric acid plants. The exchanging tubes must be effectively cooled.

The process boiler downstream of the catalytic converter installed in ammonia synthesis plants is an example of a vertical shell-and-tube vapor generator with "U" tubes or bayonet tubes; boiling water at high pressure (>5-10 MPa) circulates on shell-side and hot synthesis gas (about 440° C.), containing high percentages of $H_2$ and $NH_3$, circulates on tube-side. Synthesis gas can cause corrosion on the exchanging tubes if the cooling of the tubes is, even locally, insufficient.

Chemical reactors for methanol synthesis are frequently of shell-and-tube type with vertical configuration, with straight exchanging tubes, with boiling water at high pressure (>3-4 MPa) circulating in the shell and synthesis gas circulating in the tubes; the tubes are filled with solid chemical catalyst. These chemical reactors operate as vertical vapor generators where boiling water removes heat from exothermic reactions occurring in the tubes. In this case, a poor cooling of the exchanging tubes, even localized, can cause damage or aging of the catalyst and promote undesired chemical reactions.

Vertical vapor generators of shell-and-tube type, with boiling shell-side fluid, can be subjected to some typical dangerous shell-side phenomena:

- Accumulation of vapor on the exchanging surfaces, resulting in overheating and corrosion;
- Accumulation of deposits or the fouling growth on the exchanging surfaces, resulting in overheating and corrosion.

Accumulation of vapor pockets and bubbles, sticked to exchanging surfaces, is promoted by high vaporization, low velocity of the boiling fluid and presence of horizontal surfaces. Accumulation of deposits or fouling growth is promoted by fouled boiling fluids, high thermal fluxes and presence of horizontal surfaces.

These dangerous phenomena especially occur in transfer-line heat exchangers, process boilers and several boiling water-cooled chemical reactors because:

- the boiling shell-side fluid is boiler water at high pressure and in a closed circuit, therefore with a high concentration of salts and metal oxides;
- the degree of vaporization is high, often equal to or greater than 10% by mass; boiling water velocity on shell-side is often low (0.2-0.5 m/s) due to natural circulation of water;
- thermal fluxes are high (>150 $kW/m^2$).

Another feature of conventional vertical shell-and-tube vapor generators with boiling shell-side fluid is the presence of horizontal baffles in the shell. The baffles are substantially plates, crossed by a portion of the exchanging tubes, whose main functions are to support the exchanging tubes, to avoid the vibration of the exchanging tubes and to deviate the upward flow of the shell-side fluid. The horizontal baffles installed in the vertical vapor generators guarantee a tortuous path of the shell-side fluid, therefore good heat exchange coefficients and a good degree of mixing of vapor and liquid phases.

However, as mentioned above, horizontal baffles installed in conventional vertical vapor generators correspond to horizontal surfaces and therefore can cause two dangerous phenomena:

- on the lower surface, i.e. the surface facing downwards, horizontal baffles can promote stagnation of vapor pockets or bubbles, especially near the tubes or in presence of large tube-bundles;
- on the upper surface, i.e. the surface facing upwards, horizontal baffles can promote accumulation of deposits by gravity and fouling growth.

Specifically, the ascending shell-side fluid flows on the lower and upper surface of the horizontal baffles with a purely horizontal component and with little or almost no speed. This results in poor removal of vapor from the lower surface and poor cleaning action on the upper surface. Both phenomena lead to serious problems for the exchanging tubes at the horizontal baffles, such as overheating and local corrosion. This is worsened when the tube-side fluid, crossing the horizontal baffle, is hot. Therefore, for process boilers and transfer-line heat exchangers, where the tube-side fluid is very hot, the potential accumulation of vapor on the lower surface and of fouling on the upper surface of the baffles can lead to damage of the exchanging tube.

The present invention provides an innovative vertical shell-and-tube vapor generator, with boiling and ascending shell-side fluid, where the baffles of the tube-bundle are configured to mitigate or eliminate the stagnation of vapor on their lower surface and the accumulation of deposits and fouling growth on their upper surface. More specifically, the present invention provides a transfer-line heat exchanger, a process boiler and a chemical reactor, with boiling and ascending water at high pressure on shell-side, characterized by increased reliability and operating life.

BRIEF DESCRIPTION OF THE INVENTION

In aspects, the present invention is based on the use of shell-side single-segment, multi-segment, or cone and truncated cone baffles characterized by:

- A slope relative to the ground level,
- The chords of the segmental baffles parallel to the ground, i.e. lying on a plane perpendicular to the longitudinal axis of the vertical vapor generator, and facing upwards,
- The circular bases of cone baffles parallel to the ground, i.e. lying on a plane perpendicular to the longitudinal axis of the vertical vapor generator, and facing upwards,
- The minor circular bases of the truncated cone baffles parallel to the ground, i.e. lying on a plane perpendicular to the longitudinal axis of the vertical vapor generator, and facing upwards.

These baffles promote the upwards release of vapor from the lower surface since the shell-side fluid also presents a vertical and upwards component flow below the baffle. Sloped baffles also promote the downward removal of deposits from the upper surface.

The vertical vapor generator may include different types of tube-bundles:

- straight exchanging tubes and two horizontal tube-sheets, one at the bottom and one at the top of the tube-bundle,
- "U" shaped exchanging tubes and a horizontal tube-sheet placed above or below the tube-bundle,
- bayonet exchanging tubes and two horizontal tube-sheets both placed above or below the tube-bundle.

Regardless of shell-side circulation type, the boiling shell-side fluid has an upward flow to promote the release and entrainment of vapor. Consequently, the shell-side fluid is introduced into the tube-bundle and extracted from the tube-bundle respectively in the lower and upper part of the tube-bundle.

In aspects, the present invention desirably mitigates vapor and impurities accumulation in the vertical vapor generator The present invention offers a technically simple and efficient solution, easy to implement, to eliminate the problems of horizontal baffles installed in conventional vertical vapor generators.

DETAILED DESCRIPTION OF THE INVENTION

Figure 1A:
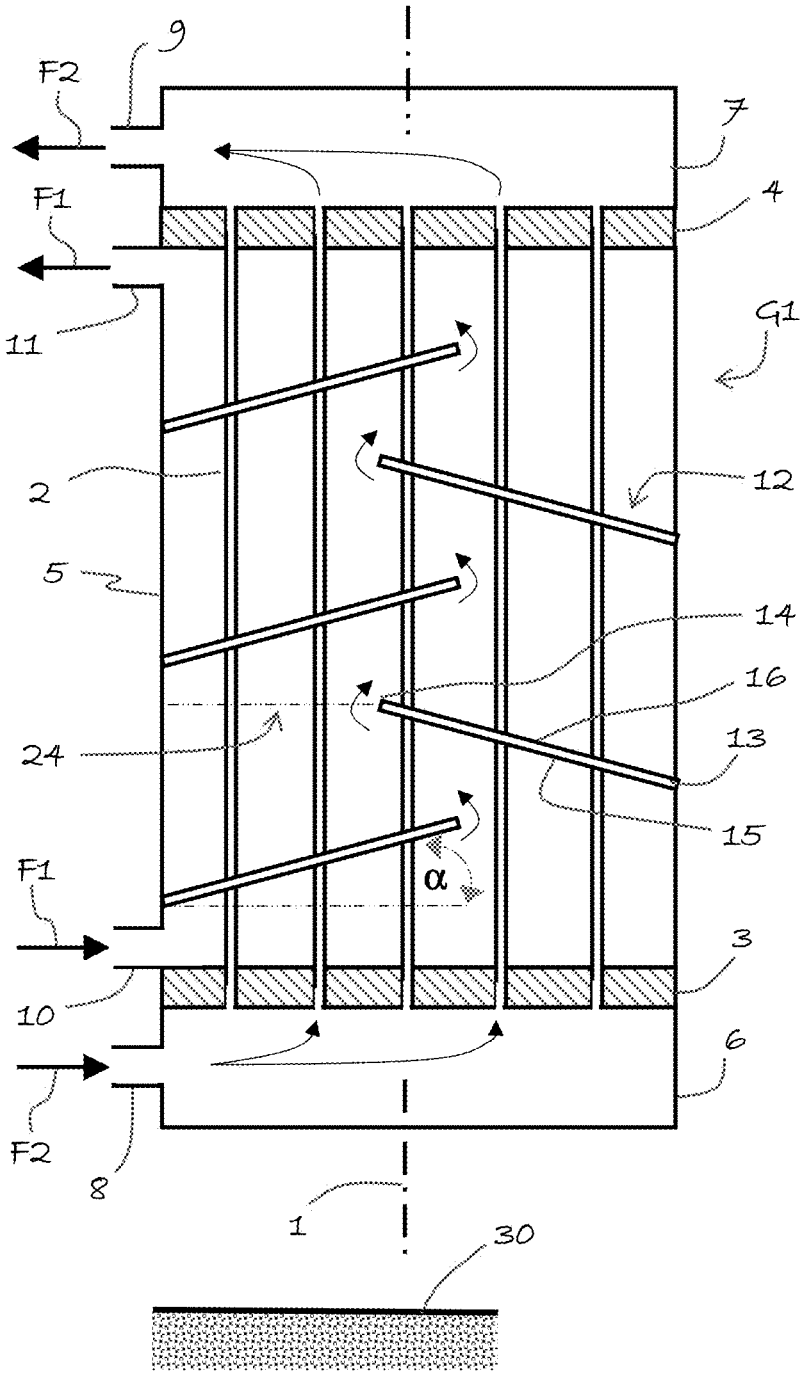
FIG. 1*a*, where the longitudinal view of the vertical vapor generator with single-segment baffles is schematically shown according to a preferred configuration of the present invention.

In one aspect, the present invention provides sloped baffles whose configuration allows to install a shell-side flow substantially two-dimensional since each baffle has the chords, or the bases, parallel to the ground and has at least a symmetry plane that contains the longitudinal axis of the exchanger.

The applicant has found that a shell-side helical flow, in general, has a high turbulence and therefore a high heat exchange efficiency. However, in the case of vertical vapor generators, the helical flow is characterized by higher pressure drops and longer path for the vapor fraction than two-dimensional flow; therefore, especially for dense or large tube-bundles and for generators in natural circulation, the shell-side velocity or the recirculation ratio for a helical flow may be lower than those for a two-dimensional flow.

The vertical vapor generator of shell-and-tube type, with shell-side boiling and ascending flow, is configured to remedy the problem of vapor stagnation and deposits accumulation that can occur respectively underneath and above conventional horizontal baffles. More particularly, the vertical vapor generator includes shell-side baffles having a slope relative to the ground so to establish a flow on the lower surface of the baffles characterized not only by a horizontal component but also by a vertical component upwardly directed. In addition, the slope also promotes the downwards removal of deposits accumulated by gravity from the upper surface of the baffles.

The shell-side baffles are of three types:

single-segment;

multi-segment;

cone and truncated cone.

It is emphasized that single- and multi-segment baffles lie on sectional planes of the shell that are sloped relative to the longitudinal axis of the vertical vapor generator or relative to the ground. In other words, single- and multi-segment baffles correspond to portions of ellipse.

Single-segment baffles are practically obtained by cutting the relative segment from an elliptical disk; single-segment baffles are portions of an elliptical disc delimited by a chord. Each single-segment baffle, as installed in the generator, has a vertical symmetry plane containing the longitudinal axis of the vapor generator. According to the present invention, single-segment baffles are characterized by:

A slope relative to the ground;

The chord parallel to the ground, i.e. lying on a plane perpendicular to the longitudinal axis;

The chord pointing upwards, i.e. the chord represents the highest point of each segment.

Consequently, the vertical vapor generator described by the present invention substantially differs from conventional equipment such as described above.

Multi-segment baffles include lateral and central segments, where each pair of lateral segments and each central segment or each pair of central segments are symmetric relative to two vertical planes perpendicular to each other and containing the longitudinal axis of the generator. The lateral segments correspond to single-segment baffles and are installed in pairs in the shell. The central segments are obtained by cutting the relevant segment from an elliptical disk; the central segments are portions of an elliptical disk delimited by two parallel chords, that is, they are elliptical segments with two bases. Multi-segment baffles frequently include only one type of central segment (double-segment baffles), positioned in the center of the tube-bundle, intersected by the longitudinal axis of the generator and with the two chords of identical length; sometimes, multi-segment baffles include a first and a second type of central segments (triple-segment baffles), the first type being positioned in the center of the tube-bundle and intersected by the longitudinal axis of the generator and the second type being composed of pair of segments positioned in a semi-central area of the tube-bundle, not intersected by the longitudinal axis and with the two chords of different lengths.

In aspects, in the present invention, the lateral segments of double-segment and triple-segment baffles installed in the shell are characterized by:

A slope relative to the ground;

The chord parallel to the ground, i.e. lying on a plane perpendicular to the longitudinal axis;

The chord pointing upwards, i.e. the chord represents the highest point of each segment.

In aspects, in the present invention, the central segments of triple-segment baffles installed in the shell and not intersected by the longitudinal axis are characterized by:

A slope relative to the ground;

The chords parallel to the ground, i.e. each lying on a plane perpendicular to the longitudinal axis;

The shortest chord facing upwards, i.e. the shortest chord represents the highest point of each segment or, alternatively, the longest chord facing upwards, i.e. the longest chord represents the highest point of each segment.

In aspects, in the present invention, the central segments of the double- and triple-segment baffles installed in the shell and intersected by the longitudinal axis are characterized by:

A longitudinal section of substantially "V" shape, with the vertex facing down and the chords, of identical length, facing upwards, i.e. the chords represent the highest point of each segment;

The chords parallel to the ground, i.e. each lying on a plane perpendicular to the longitudinal axis.

The central segments of the double- and triple-segment baffles intersected by the longitudinal axis therefore also have a slope relative to the ground; they can practically be formed by bending a single double-base elliptical segment in a "V" shape or by combining two sloped double-base elliptical segments to form a "V".

The cone and truncated cone baffles correspond to the lateral surfaces of a cone and a truncated cone respectively and are axial-symmetric relative to the longitudinal axis of the vertical vapor generator; cone and truncated cone baffles are, basically, shaped sheets. In aspects, in the present invention, cone and truncated cone baffles are characterized by:

- A slope relative to the ground, corresponding to the angle in the center of related cones;
- The base of the cone baffle facing upwards, that is, the base of the cone baffle is the highest point of any cone baffle;
- The minor base of the truncated cone facing upwards, that is, the minor base of the truncated cone is the highest point of any truncated cone baffle.

Since cone and truncated cone baffles are axial-symmetric, their circular bases lie in a plane perpendicular to the longitudinal axis.

In aspects, in the present invention, baffles are installed along the longitudinal axis so that they are staggered and/or alternated. More specifically:

- for single-segment baffles, adjacent baffles are rotated by 180 degrees relative to the longitudinal axis,
- for multi-segment baffles, segments or pair of segments of different type are alternate along the longitudinal axis.
- for cone and truncated cone baffles, cone baffles alternate with truncated cone baffles along the longitudinal axis.

As an expert in the field knows, the diameter of the disc from which conventional single- and multi-segment horizontal baffles, installed in vertical vapor generators, are obtained, is equivalent to or greater than the diameter of the outside tube-bundle limit. The diameter of the disc from which conventional single- and multi-segment horizontal baffles are obtained is comparable to the internal diameter of the shell and, specifically, normally less than at least 3-12 mm about; this small difference, usually called "tolerance", allows an easy construction of the tube-bundle and at the same time a reduced bypass of the shell-side fluid. The baffles in aspects of the present invention have the same construction tolerances as conventional baffles. In other words, the elliptical discs from which single- and multi-segment baffles are obtained and the major base of the truncated cone baffles, have diameters equivalent to or greater than the diameter of the outside tube-bundle limit and comparable to the internal diameter of the shell of the vertical vapor generator according to the construction tolerances.

Horizontal single- and multi-segment baffles of a conventional vertical vapor generator are characterized by the so-called "cut", i.e. the cross-flow area in the shell, or alternatively the percentage of the cross-flow area in the shell, available to the fluid at a baffle. In other words, the cut of horizontal baffles installed in a conventional vertical vapor generator corresponds to the missing circular segment (single-segment baffle), or to the missing circular segments (multi-segment baffles), relative to the disk from which the baffles are obtained. The cut of horizontal single- and multi-segment baffles installed in a vertical vapor generator is therefore a crossflow area or section parallel to the ground.

As an expert in the field knows, the cut of a horizontal single- or multi-segment baffle installed in a conventional vertical vapor generator, is identified with the chord or chords that delimit the circular segment.

In aspects, in the present invention, where the single-segment and multi-segment baffles are sloped with respect to the ground and the relative chords are parallel to the ground, the cut of the single-segment and multi-segment baffles is still identified with the chord or chords that delimit the elliptical segment. More specifically, the cut of single-segment and multi-segment baffles corresponds to the internal transversal crossflow area or section of the shell net of the baffle area projected on a plane parallel to the ground.

As for the cone and truncated cone baffles object of this invention, the cut of cone baffles is identified with the circular crown delimited by the shell and the base of the cone, while the cut of the truncated cone baffles is identified with the minor base. In other words, the cut of the cone and truncated cone baffles corresponds to the internal transversal crossflow area or section of the shell net of the baffle area projected on a plane parallel to the ground.

From the above, the cut of the baffles in aspects of the present invention can also be defined as the minimum crossflow area, or the percentage of the minimum crossflow area, available for the shell-side fluid at a baffle.

From the above, the baffles have a perimeter that is formed by either a first or a first and second portion as follows:

- a first portion passing through the tube-bundle, corresponding to the chords of the single- or multi-segment baffles or to the circumference of the base of the cone baffles or to the circumference of the minor base of the truncated cone baffles,
- a second portion that does not pass through the tube-bundle and that circumscribes, at least partially, the tube-bundle, corresponding to the elliptical arcs delimited by the chords of the single- and multi-segment baffles or to the circumference of the major base of the truncated cone baffles.

Normally, the baffles cut installed in vertical vapor generators is wide so not to obstruct the upwards vapor flow and, in general, the natural circulation; the baffles cut installed in vertical vapor generators can be 45-50% of the internal cross section of the shell. The baffles preferably have a cut between about 30% and 50% of the internal cross section of the shell.

Single-segment, multi-segment and cone and truncated cone baffles deviate the ascending flow of the shell-side fluid according to a transverse component. Single- and multi-segment baffles deviate the upward flow according to a single direction horizontal to the ground, while cone and truncated cone baffles deviate the upward flow in a radial direction. The ascending flow of the shell-side fluid is substantially two-dimensional since a fluid thread substantially moves along the vertical direction and along only one horizontal direction; in other words, a fluid thread of the shell-side fluid essentially lies on a vertical plane. Moreover, the flow of the shell-side fluid, in aspects of the present invention, is substantially symmetric to at least a vertical plane containing the longitudinal axis of the vapor generator. Single-segment, multi-segment and cone and truncated cone baffles, therefore, do not create a three-dimensional flow on shell-side, such as a helical flow. Consequently, as already explained above, the present invention baffles installed on shell-side are substantially different from those described in the cited patent documents (WO2009148822, U.S. Pat. Nos. 6,827,138, 1,525,094 and 4,493,368).

As one of ordinary skill in the field can understand, the flow of shell-side fluid can be locally three-dimensional, such as near an inlet or outlet connection; however, the vertical vapor generator in aspects of the present invention is configured to have an overall flow on shell-side substantially two-dimensional.

More specifically, single-segment, multi-segment and cone and truncated cone baffles allow to establish on the lower and upper surface of the baffles a shell-side flow also characterized by a vertical component. This effectively allows to remove vapor and impurities that respectively form on the lower and upper surfaces of the baffles.

The vertical vapor generator may include a shell-side internal wall substantially cylindrical, concentric relative to the shell and surrounding the tube-bundle. In this case, the baffles are to be related to the internal wall.

In this description, reference is made to "U" exchanging tubes when each exchanging tube includes two straight legs hydraulically connected to each other by a "U" bend at one end and connected to a tube-sheet at the other end.

In this description, reference is made to bayonet tubes when each exchanging tube includes two concentric straight tubes, where the outer one has the end far from the first tube-sheet that is free and plugged and the other end connected to the first tube-sheet, while the inner one has the end far from the second tube-sheet that is free and open and the other end connected to the second tube-sheet.

This description also covers the operating method of the vertical vapor generator object of this invention; in particular, this description illustrates how the problem of the vapor and impurities accumulation respectively under and above the baffles is solved from an operational point of view. Consequently, the present invention also offers an operating method for vertical shell-and-tube vapor generators, with boiling and ascending shell-side fluid; in particular, the present invention, in aspects, offers an operating method for transfer-line heat exchangers for ethylene plants, process boilers and tubular chemical reactors cooled by boiling water on shell-side.

FIG. 1*a* schematically shows the longitudinal view of the vertical vapor generator (G1) according to a preferred configuration of the present invention.

The vertical vapor generator (G1) shown in FIG. 1*a* has a substantially cylindrical geometry with a longitudinal axis (1) perpendicular to the ground level (30). The vertical vapor generator (G1) is of shell-and-tube type and includes straight exchanging tubes (2) whose ends are connected to the bores of two horizontal tube-sheets (3,4), one placed at the bottom (3) and one at the top (4). The vertical vapor generator (G1) also includes a shell (5), enveloping the tube-bundle and connected to the two tube-sheets (3,4), two tube-side distributors (6,7) each connected to a tube-sheet (3,4) on the side opposite the tube-bundle, tube-side inlet and outlet connections (8,9) placed on the distributors (6,7), shell-side inlet and outlet connections (10,11) placed on the shell (5) respectively at the bottom and top. The distributors (6,7) and the exchanging tubes (2) are in fluid communication with each other.

According to FIG. 1*a*, the shell-side fluid (F1) is introduced into, and extracted from, the vertical vapor generator (G1) respectively through the shell-side inlet connection located at the bottom (10) and the shell-side outlet connection placed at the top (11). The shell-side fluid (F1) moves upwards across the tube-bundle, indirectly receiving heat from the tube-side fluid (F2) and boiling. Preferably, the shell-side fluid (F1) is fed into the vertical vapor generator (G1) in liquid phase. Preferably, the shell-side fluid (F1) is fed into the vertical vapor generator (G1) under saturation or incipient saturation conditions. The tube-side fluid (F2) is fed into the vertical vapor generator (G1) through the tube-side inlet connection at the bottom (8) and is extracted from the vertical vapor generator (G1) through the tube-side outlet connection at the top (9). The tube-side fluid (F2) is distributed in the exchanging tubes (2) through the distributor at the bottom (6), flows upwards into the exchanging tubes (2) indirectly transferring heat to the shell-side fluid (F1), and is collected by the exchanging tubes (2) through the distributor placed at the top (7). According to another preferred configuration of the present invention (not shown in the attached figures), the tube-side fluid (F2) is introduced through the tube-side connection at the top (9), flows into the exchanging tubes (2) downwards indirectly releasing heat to the shell-side fluid (F1), and is extracted from the tube-side connection at the bottom (10). In the exchanging tubes (2) a solid, such as a chemical catalyst for exothermic chemical reactions within the tube-side fluid (F2), can be loaded.

According to FIG. 1*a*, the vertical vapor generator (G1) includes single-segment baffles (12) installed in the shell (5), each crossed by a portion of the exchanging tubes (2). The single-segment baffles (12) are staggered and alternate along the longitudinal axis (1). Single-segment baffles (12) support the exchanging tubes (2), dampen the vibrations of the exchanging tubes (2) and deviate the upward flow of the shell-side fluid (F1). The shell-side flow is substantially two-dimensional except near the shell-side inlet and outlet connections (10,11) where the flow can be locally three-dimensional. The single-segment baffles (12) have the elliptical arc (13), delimited by the chord (14), which partially circumscribes the tube-bundle and which is adjacent the shell (5) according to the construction tolerance. Single-segment baffles (12) are sloped by an angle ($\alpha$) relative to the ground (30) and have the chord (14) parallel to the ground (30), i.e. lying on a plane perpendicular to the longitudinal axis (1), and facing upwards. Preferably, the angle of slope ($\alpha$) is between 0 and 45 degrees, and more preferably between 10 and 30 degrees. Single-segment baffles (12) have a cut (24) that can range from about 15% to 50%; preferably, the cut (24) of the single-segment baffles (12) is between about 30% and 50%. Single-segment baffles (12) have an upper surface (16), or a surface facing upwards, and a lower surface (15), or a surface facing downwards.

Figure 1B:
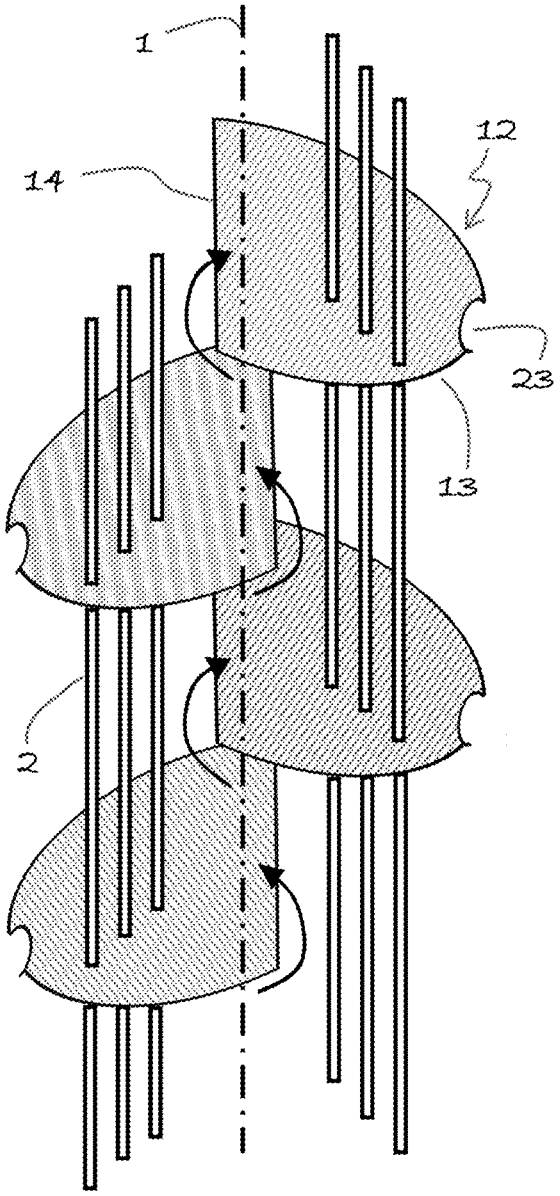
FIG. 1*b*, where a perspective view of a detail of the tube-bundle of the vertical vapor generator with single-segment baffles is schematically shown according to a preferred configuration of the present invention.

FIG. 1*b* schematically shows a perspective view of a portion of the tube-bundle of the vertical vapor generator (G1) according to a preferred configuration. Basically, FIG. 1*b* shows some exchanging tubes (2) and some single-segment baffles (12) as described in FIG. 1*a*. The single-segment baffles (12) are characterized by the chord (14) parallel to the ground (30), crossing the tube-bundle and facing upwards, and by the elliptical arc (13), delimited by the chord (14), which partially circumscribes the tube-bundle and which is adjacent the shell. Single-segment baffles (12) have passages or slots (23) on the elliptical arc (13). Preferably, the passages or slots (23) are positioned at the lowest point of the single-segment baffle (12).

Figure 2A:
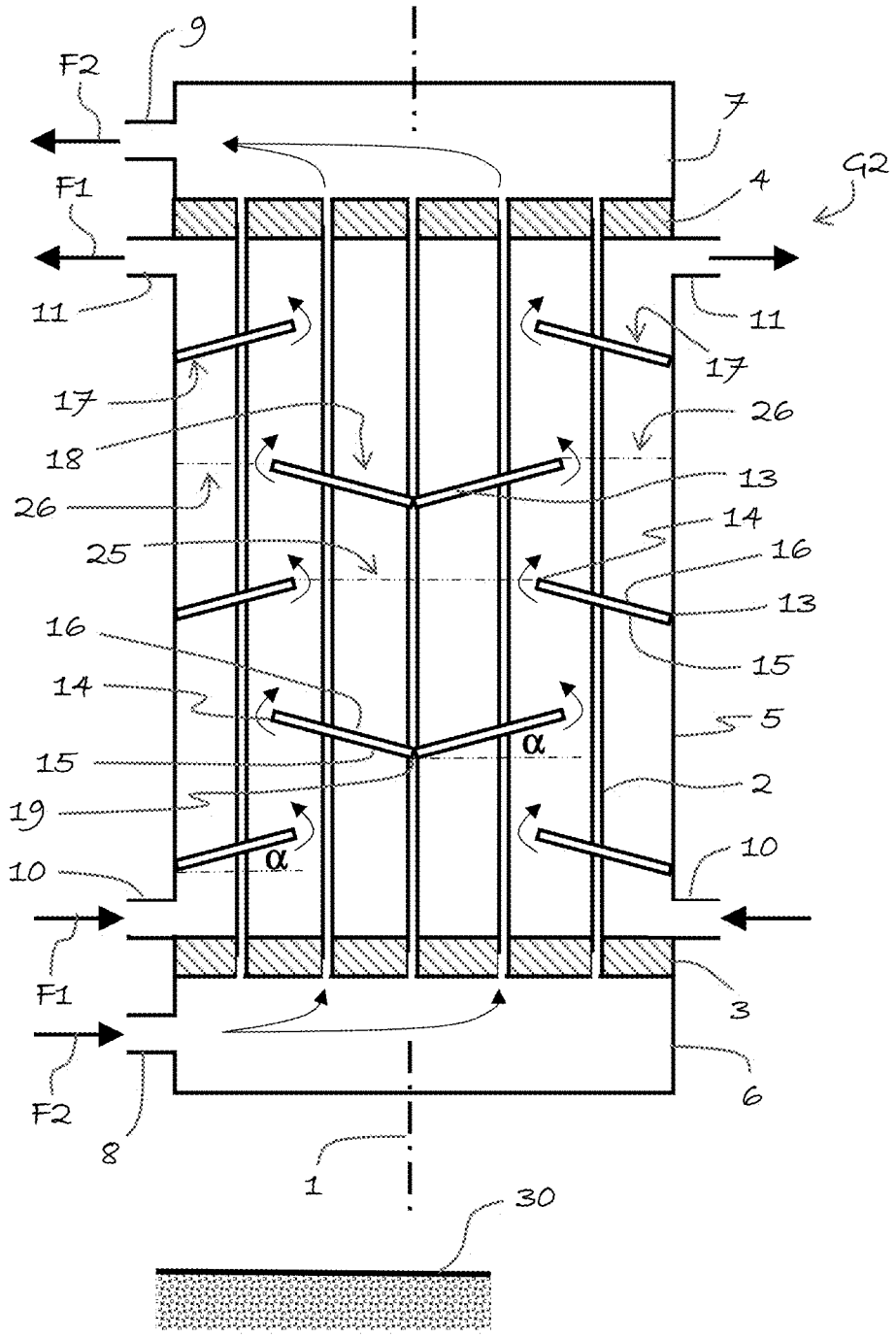
FIG. 2*a*, where the longitudinal view of the vertical vapor generator with multi-segment baffles is schematically shown according to a preferred configuration of the present invention.

FIG. 2*a* schematically shows the front view of the vertical vapor generator (G2) according to another preferred configuration of the present invention.

The vertical vapor generator (G2) of FIG. 2*a* is structurally equivalent to that of FIG. 1*a* except for the baffles of the tube-bundle which are multi-segment; in other words, the elements and construction details, and the relative numbering, of the vertical vapor generator (G2) shown in FIG. 2*a* are equivalent to those of the vertical vapor generator (G1) shown in FIG. 1*a*, except for the baffles. Therefore, for simplicity, the description of the vertical vapor generator (G2) of FIG. 2*a* is partially omitted.

According to FIG. 2*a*, the vertical vapor generator (G2) includes double-segment baffles (17,18) installed in the shell (5), each crossed by a portion of the exchanging tubes (2). The double-segment baffles (17,18) shown in FIG. 2*a* are symmetric both relative to the plane containing the longitudinal axis (1) and perpendicular to the chords (14) of the baffles (17,18) and relative to the plane containing the longitudinal axis (1) and parallel to the chords (14) of the baffles (17,18). Double-segment baffles (17,18) include a pair of lateral segments (17) and a central segment (18). The lateral and central segments (17,18) alternate along the longitudinal axis (1) of the vertical vapor generator (G2) and are staggered. The double-segment baffles (17,18) support the exchanging tubes (2), dampen the vibrations of the exchanging tubes (2) and deviate the upward flow of the shell-side fluid (F1) according to a single horizontal component. The shell-side flow (F1) is therefore substantially two-dimensional except near the shell-side inlet and outlet connections (10,11) where the flow can be locally three-dimensional. The lateral segments (17) have the elliptical arc (13), delimited by the chord (14), which partially circumscribes the tube-bundle and which is adjacent the shell (5) according to the construction tolerance. The central segment (18), substantially "V" shaped, has the two elliptical arcs (13), delimited by the chords (14), which partially circumscribe the tube-bundle and which are adjacent the shell (5) according to the construction tolerance. Double-segment baffles (17,18) are sloped by an angle ($\alpha$) relative to the ground (30), have chords (14) parallel to the ground (30) and facing upwards. Preferably, the angle of slope ($\alpha$) is between 0 and 45 degrees, and more preferably between 10 and 30 degrees. The cut (25) of the lateral segments (17)) involves a central area of the tube-bundle, corresponding to a two-base elliptical segment; the cut (26) of the central segments (18) involves a peripheral area of the tube-bundle, corresponding to two elliptical segments. The cut (25,26) can range from about 15% to 50%; Preferably, the cut (25,26) of double-segment baffles (17,18)) is between about 30% and 50%. Double-segment baffles (17,18) have an upper surface (16), or a surface facing upwards, and a lower surface (15), or a surface facing downwards.

Figure 2B:
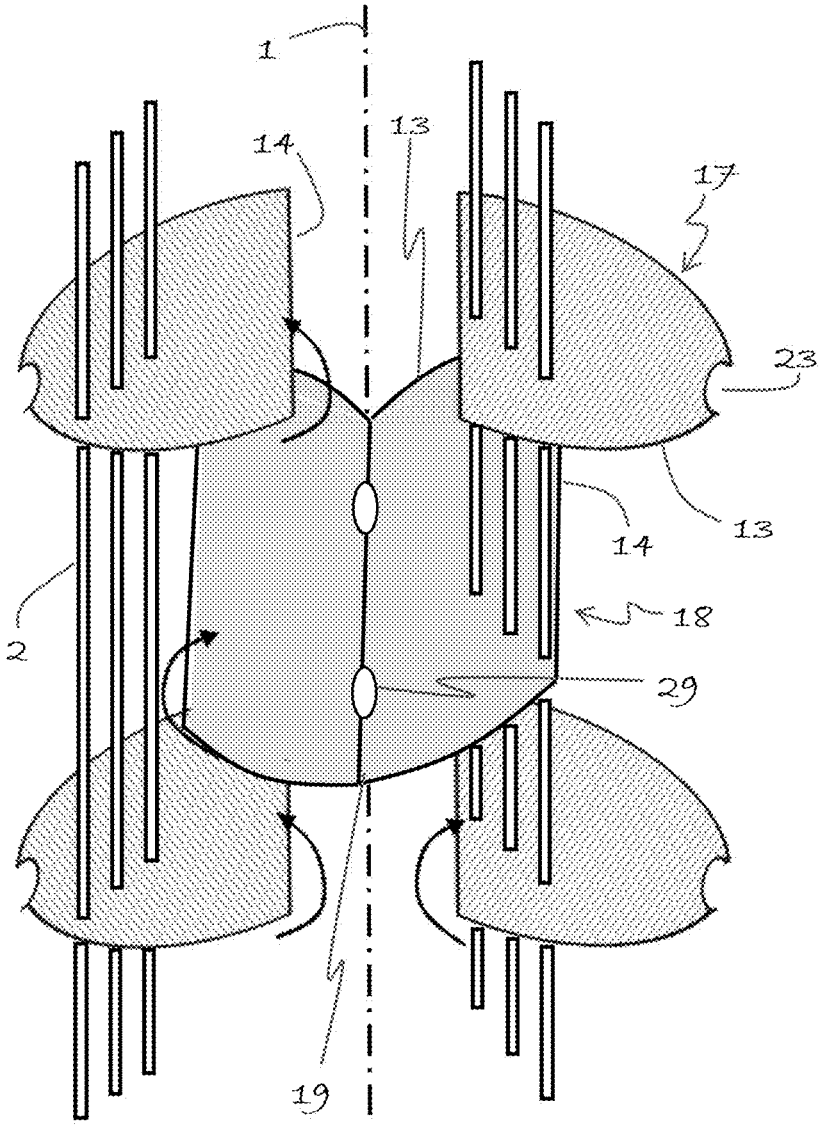
FIG. 2*b*, where a perspective view of a detail of the tube-bundle of the vertical vapor generator with multi-segment baffles is schematically shown according to a preferred configuration of the present invention.

FIG. 2*b* schematically shows a perspective view of a portion of the tube-bundle of the vertical vapor generator (G2) according to a preferred configuration. Basically, FIG. 2*b* shows some exchanging tubes (2) and some double-segment baffles (17,18) as described in FIG. 2*a*. The double-segment baffles (17,18) are characterized by chords (14) parallel to the ground (30), crossing the tube-bundle and facing upwards, and by elliptical arcs (13), delimited by chords (14), which partially circumscribe the tube-bundle and which are adjacent the shell. The lateral segments (17) may be provided with passages or slots (23) placed on the elliptical arc (13). Preferably, passages or slots (23) are located at the lowest point of the lateral segment (17). The central segments (18) may be provided with passages or slots (29) located at the vertex (19) of the longitudinal "V" section.

As one of ordinary skill in the field can understand, FIG. 2*a* and FIG. 2*b* and their descriptions can be easily adapted to triple-segment baffles as described above. In other words, triple-segment baffles are contemplated herein.

Figure 3A:
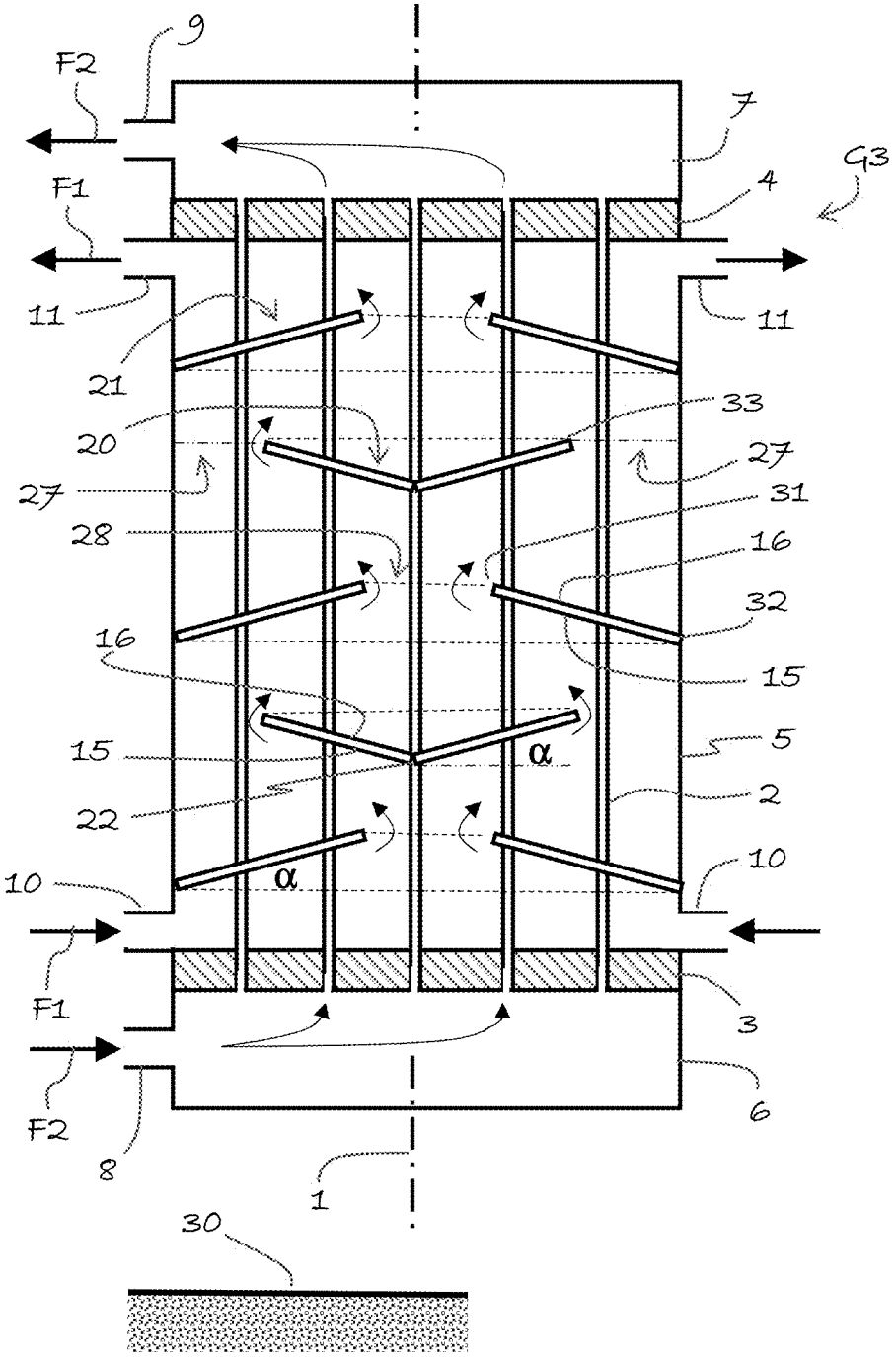
FIG. 3*a*, where the longitudinal view of the vertical vapor generator with cone and truncated cone baffles is schematically shown according to a preferred configuration of the present invention.

FIG. 3*a* schematically shows the front view of the vertical vapor generator (G3) according to another preferred configuration of the present invention.

The vertical vapor generator (G3) of FIG. 3*a* is structurally equivalent to that of FIG. 1*a* except for the baffles of the tube-bundle that are cone and truncated cone; in other words, the elements and construction details, and the relative numbering, of the vertical vapor generator (G3) shown in FIG. 3*a* are equivalent to those of the vertical vapor generator (G1) shown in FIG. 1*a*, except for baffles. Therefore, for simplicity, the description of the vertical vapor generator (G3) of FIG. 3*a* is partially omitted.

According to FIG. 3*a*, the vertical vapor generator (G3) includes cone and truncated cone baffles (20,21) installed in the shell (5), each crossed by a portion of the exchanging tubes (2). The cone and truncated cone baffles (20,21) shown in FIG. 3*a* alternate along the longitudinal axis (1) of the vertical vapor generator (G3), are aligned along the longitudinal axis (1) but do not completely overlap each other. Cone and truncated cone baffles (20,21) support the exchanging tubes (2), dampen the vibrations of the exchanging tubes (2) and deviate the ascending flow of the shell-side fluid (F1) according to a radial component. In other words, the shell-side flow is substantially two-dimensional except near the inlet and outlet connections on shell-side (10,11) where the flow can be locally three-dimensional. The truncated cone baffle (21) has the circumference of the major base (32) that circumscribes the tube-bundle and that is adjacent the shell (5) according to the construction tolerance, and has the circumference of the minor base (31) that passes through the tube-bundle. The circular base (33) of the cone baffle (20) has a diameter smaller than the diameter of the tube-bundle outside limit and, more precisely, passes through the tube-bundle. The circular base (33) of the cone baffle (20) preferably has a larger diameter than the minor circular base (31) of the truncated cone baffle (21). The circular base (33) of the cone baffle (20) and the minor base (31) of the truncated cone baffle (21) point upwards. The cone and truncated cone baffles (20,21) shown in FIG. 3*a* are sloped by an angle ($\alpha$) relative to the ground (30); the angle of slope ($\alpha$) corresponds to the angle at the center of the cone related to the baffles (20,21). Preferably, the angle of slope ($\alpha$) is between 0 and 45 degrees, and more preferably between 10 and 30 degrees. The cut (27,28) can range from 15% to about 50%; preferably, the cut of cone and truncated cone baffles (27,28) is between about 30% and 50%. Cone and truncated cone baffles (20,21) have an upper surface (16), or surface facing upwards, and a lower surface (15), or surface facing downwards.

Figure 3B:
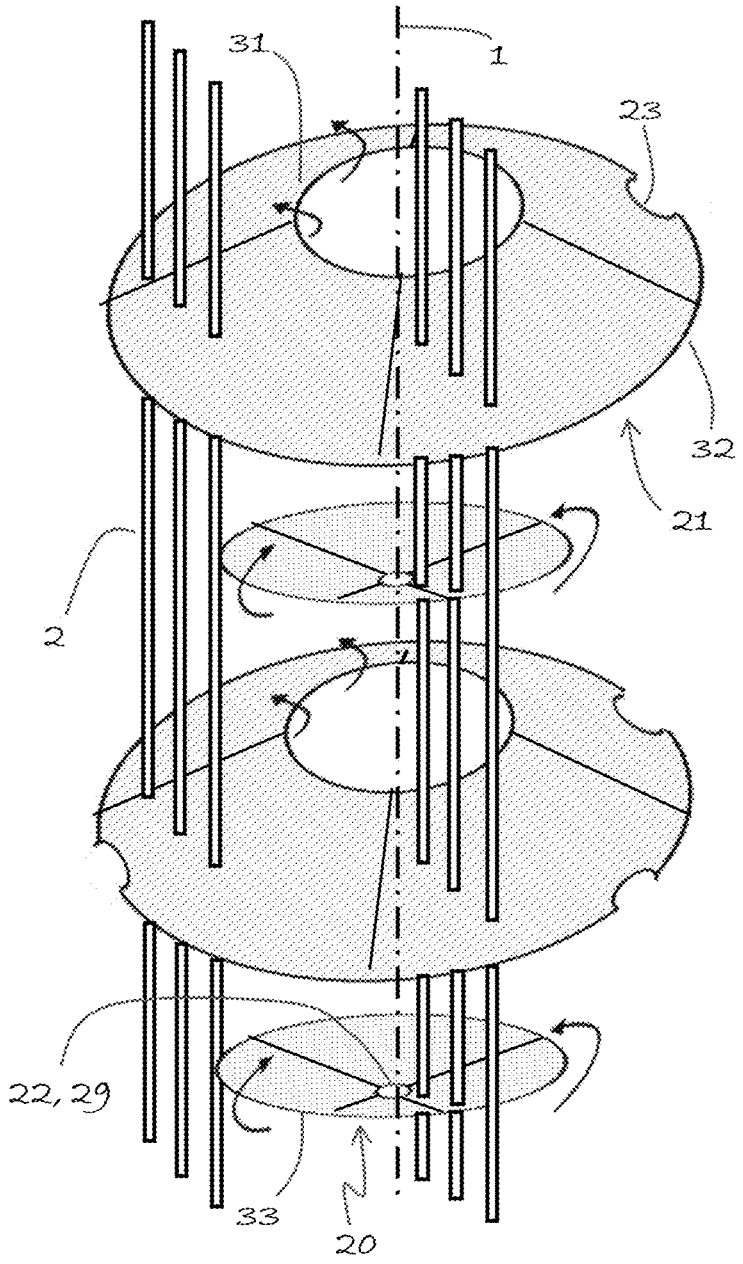
FIG. 3*b*, where a perspective view of a detail of the tube-bundle of the vertical vapor generator with cone and truncated cone baffles according to a preferred configuration of the present invention is schematically shown.

FIG. 3*b* shows a perspective view of a portion of the tube-bundle of the vertical vapor generator (G3) according to a preferred configuration. Basically, FIG. 3*b* shows some exchanging tubes (2) and some cone and truncated cone baffles (20,21) as described in FIG. 3*a*. The cone baffle (20) is characterized by a circular base (33) parallel to the ground (30) and a vertex (22) facing downwards; The truncated cone baffle (21) is characterized by a minor circular base (31) facing upwards and a major circular base (32) facing downwards, both parallel to the ground (30). The cone baffle (20) has a central opening or slot (29) at or in the vertex (22). The truncated cone baffle (21) has lateral passages or slots (23) on the major circular base (32).

Figure 4:
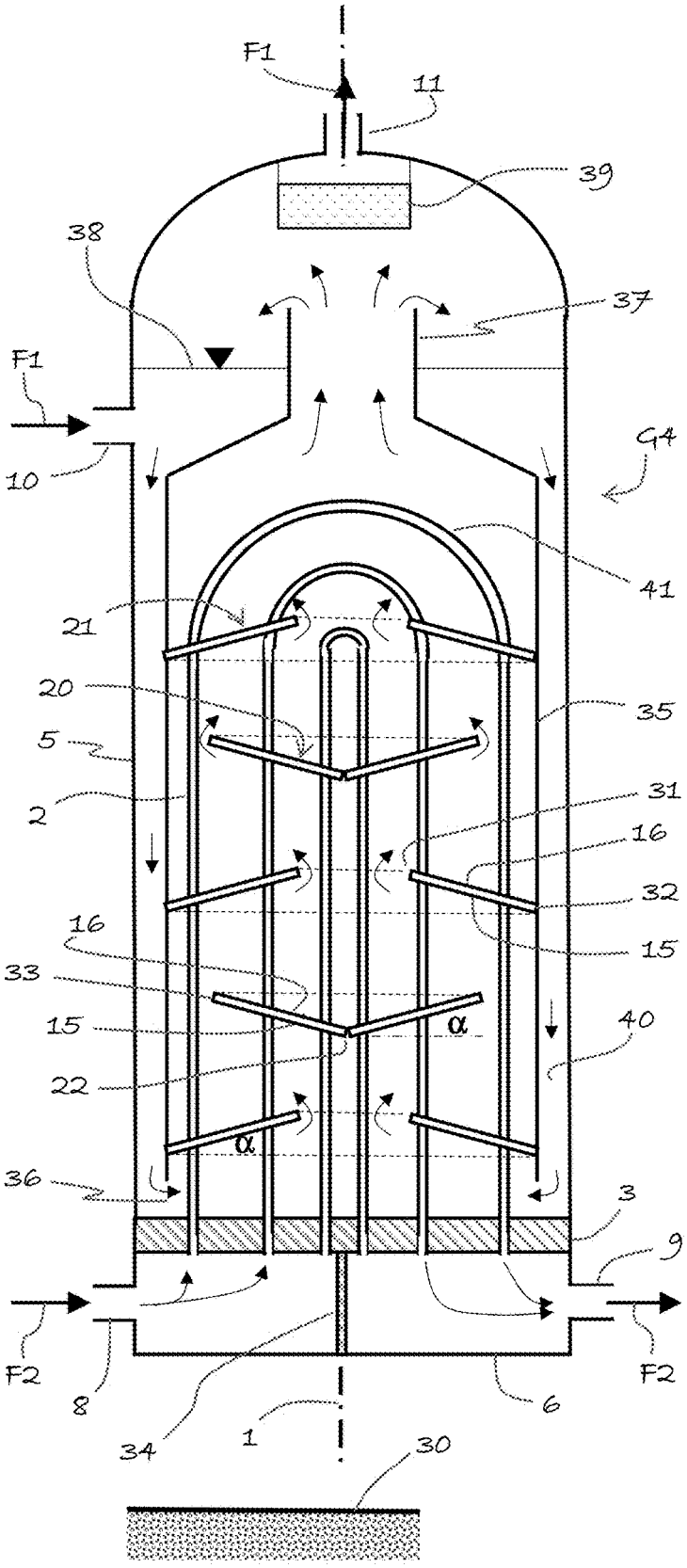
FIG. 4, where the longitudinal view of the vertical vapor generator with cone and truncated cone baffles is schematically shown according to a preferred configuration of the present invention.

FIG. 4 schematically shows the front view of the vertical vapor generator (G4) according to another preferred configuration of the present invention.

The vertical vapor generator (G4) of FIG. 4 has a substantially cylindrical geometry with longitudinal axis (1) perpendicular to the ground level (30). The vertical vapor generator (G4) is of shell-and-tube type and includes "U" shaped exchanging tubes (2) having two sets of straight legs where at one end they are connected to the bores of a horizontal tube-sheet (3), placed at the bottom of the tube-bundle, and at the other end they are hydraulically connected by a "U" bend (41) placed at the top. The vertical vapor generator (G4) also includes a shell (5) enveloping the tube-bundle and connected to the tube-sheet (3), a tube-side distributor (6) connected to the tube-sheet (3) on the side opposite the tube-bundle, tube-side inlet and outlet connections (8,9) placed on the distributor (6), shell-side inlet and outlet connections (10,11) placed on the shell (5). The distributor (6) is equipped with internal walls or boxes on the tube-side (34) configured to separate the distributor (6) into two chambers not in direct fluid communication with each other, where one chamber is in fluid communication with the tube-side inlet connection (8) and with a set of legs of the exchanging tubes (2), and the other is in fluid communication with the other set of legs of the exchanging tubes (2) and with the tube-side outlet connection (9).

The vertical vapor generator (G4) of FIG. 4 also includes an internal wall on shell-side (35) substantially cylindrical and concentric relative to the shell (5), surrounding the tube-bundle and forming with the shell (5) a substantially annular duct (40). The inner wall on the shell-side (35) has at least a lower opening (36), i.e. placed at the bottom, to enter the shell-side fluid (F1) in the lower part of the tube-bundle and at least an upper opening (37), i.e. placed at the top, to extract the shell-side fluid (F1) from the upper part of the tube-bundle. The vertical vapor generator (G4) is configured to form a liquid level (38) in the shell (5), positioned below the upper opening (37) of the shell-side inner wall (35). The vertical vapor generator (G4) also includes liquid level (38) control systems (not shown in the figure) and phase separation devices (39) installed in the shell area above the liquid level (38), i.e. in the shell vapor chamber.

According to FIG. 4, the shell-side fluid (F1) is fed into the vertical vapor generator (G1) through the inlet connection on shell-side (10); the shell-side fluid (F1) introduced through the shell-side inlet connection (10) mixes, in the annular duct (40), with the shell-side fluid (F1) constituting the liquid level (38), i.e. with the shell-side fluid (F1) already present in the shell (5) and recirculating in the shell (5). The shell-side fluid (F1) flows downwards into the annular duct (40), enters the lower part of the tube-bundle through the lower opening (36) and then flows upwards across the tube-bundle. The shell-side fluid (F1) indirectly receives heat from the tube-side fluid (F2) and boils. The shell-side fluid (F1) exits from the upper part of the tube-bundle through the upper opening (37) in liquid and vapor phase and undergoes liquid-vapor separation by gravity and by phase separation devices (39); the separated liquid forms the liquid level (38) while the separated vapor exits from the vertical vapor generator (G4) through the outlet connection on shell-side (11). Preferably, the shell-side fluid (F1) is fed into the vertical vapor generator (G4) in liquid phase, in sub-cooling or saturation or incipient saturation conditions. The tube-side fluid (F2) is fed into the vertical vapor generator (1) through the tube-side inlet connection (8) and is extracted from the vertical vapor generator (G4) through the tube-side outlet connection (9). The tube-side fluid (F2) is distributed in the exchanging tubes (2) through the first chamber of the distributor (6), flows upwards into the first set of legs and downwards into the second set of legs of the exchanging tubes (2) indirectly transferring heat to the shell-side fluid (F1), and is collected by the exchanging tubes (2) through the second chamber of the distributor (7). The vertical vapor generator (G4) can also include liquid drain and/or vapor vent shell-side connections and shell-side connections for other instrumentation (not shown in the figure).

According to FIG. 4, the vertical vapor generator (G4) includes cone and truncated cone baffles (20,21) installed in the shell (5), each crossed by a portion of the exchanging tubes (2). The cone and truncated cone baffles (20,21) of FIG. 4 are structurally equivalent to those of FIG. 3*a* except for the shell-side inner wall (35); in other words, the elements and construction details, and the relative numbering, of the cone and truncated cone baffles (20,21) shown in FIG. 4 are equivalent to those of the vertical vapor generator (G3) shown in FIG. 3*a*, except for the shell-side internal wall (35) which replaces the shell (5) in the description. Therefore, for simplicity, the description of the cone and truncated cone baffles (20,21) of FIG. 4 is omitted, and reference is made to the description relating to FIG. 3*a*.

One of ordinary skill in the field can understand that the vertical vapor generator (G4) of FIG. 4 can include, instead of cone and truncated cone baffles (20,21), single- or multi-segment baffles (12,17,18) as described in FIG. 1*a*, FIG. 1*b*, FIG. 2*a* and FIG. 2*b*, and those are contemplated herein, without departing from the spirit of the present invention. Consequently, the detailed description of the vertical vapor generator with U-tubes and tube-sheet placed at the bottom, as shown in FIG. 4, having single- or multi-segment baffles (12,17,18) instead of cone and truncated cone baffles (20,21) is omitted here.

Figure 5:
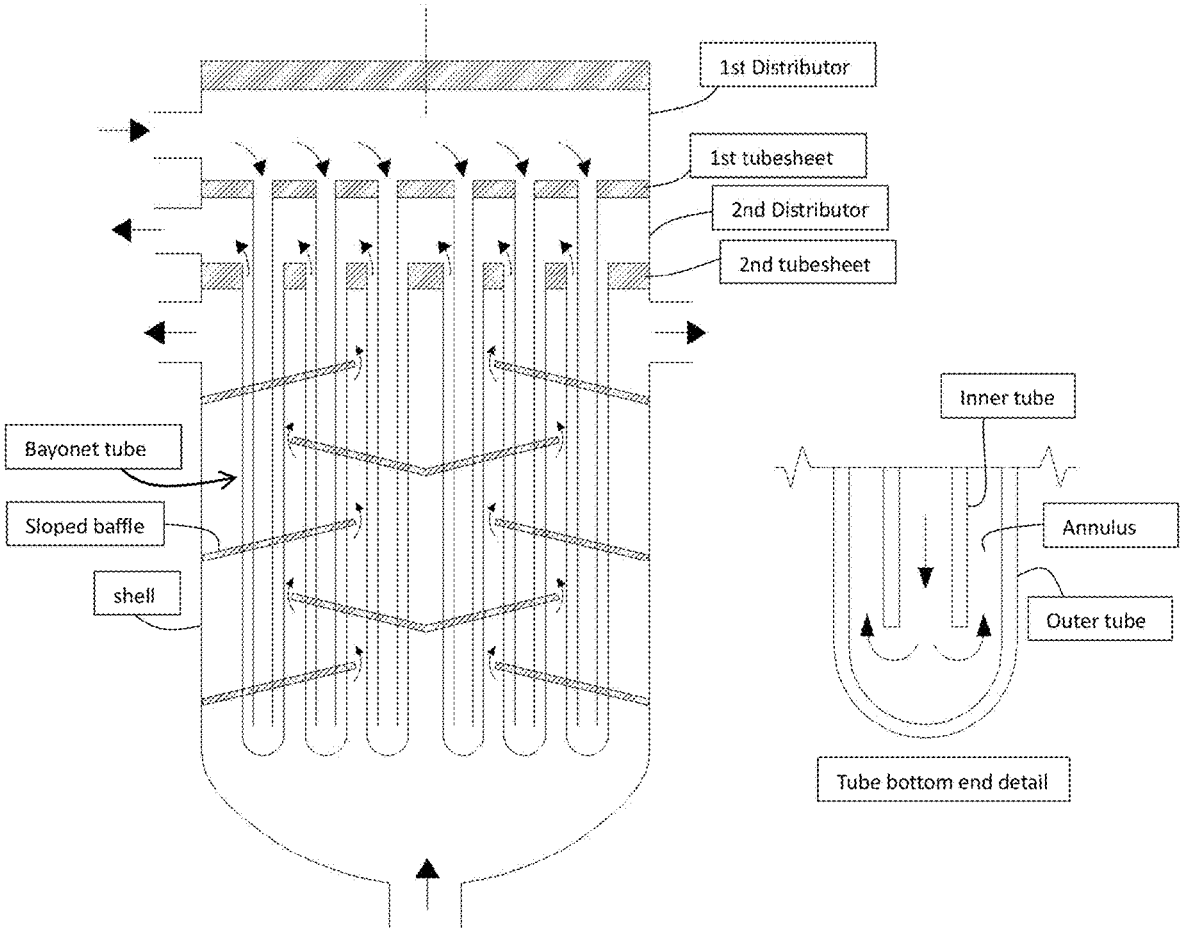
FIG. 5, where the longitudinal view of a one embodiment of the vertical shell-and-tube vapor generator having a bayonet type tube bundle is schematically shown.

According to FIG. 5, a bayonet-tube includes two elements: a bayonet and a bayonet hilt. The bayonet is an inner tube, and the hilt is an outer tube. The inner tube is inserted into the outer tube forming an annulus. The inner tube is connected to a first tubesheet and is open at both ends. The outer tube is connected to a second tubesheet and is open at one end only; the end far from the second tubesheet is closed. Therefore, the tube-side fluid either enters the inner tube, flows in the inner tube, has a U-turn, flows in the annulus and exits the outer tube, or enters the outer tube, flows in the annulus, has a U-turn, flows in the inner tube and exits the inner tube. Bayonet-tubes are interesting from thermo-mechanical standpoint since they can absorb differential thermal elongation between shell and tube-bundle and between inner and outer tube.

According to a preferred alternative configuration (not shown in the figures), the vertical vapor generator includes downward-facing U-tubes (2) and the tube-sheet (3) and tube-side distributor (6) placed at the top. The shell-side fluid (F1) is introduced into the lower part of the tube-bundle, moves upwards by crossing the tube-bundle and boils, and is extracted from the upper part of the tube-bundle; accordingly, the boiling shell-side fluid has always an upward flow. The baffles installed in the shell can be single-segment (12), or multi-segment (17,18) or cone and truncated cone (20,21) as described in this invention.

According to the attached FIG. 1*a*, FIG. 1*b*, FIG. 2*a*, FIG. 2*b*, FIG. 3*a*, FIG. 3*b*, FIG. 4, and FIG. 5 and relative above descriptions, single-segment, multi-segment and cone and truncated cone baffles (12,17,18,20,21) deviate the ascending flow of the shell-side fluid (F1) so that the shell-side fluid (F1) crosses the tube-bundle according to a horizontal flow component. The deviation of the shell-side flow allows to maintain high heat transfer coefficients on shell-side and to maintain a mixing between vapor and liquid phases in the shell. The boiling generates bubbles within the shell-side fluid (F1) that move upwards both by natural convection and by liquid entrainment. The bubbles are also formed near the lower surface (15) of single-segment (12), multi-segment (17,18) and cone and truncated cone (20,21) baffles; mostly, the bubbles in their upward flow tend to collide and accumulate on the lower surface (15) of the baffles (12,17,18, 20,21). However, according to an aspect of the present invention, the slope of single-segment (12), multi-segment (17,18) and cone and truncated cone (20,21) baffles promotes the upward outflow of bubbles from the lower surface (15); specifically, the configuration of the baffles (12,17,18,20,21) makes the rising bubbles to collide on a sloped surface, rather than horizontal, and at the same time allows the shell-side fluid (F1) to have a vertical and upwardly-directed flow component on the lower surface of the baffles (15). This mitigates or eliminates the formation of stagnant vapor pockets or the accumulation of bubbles on the lower surface (15) of the baffles (12,17,18,20,21) and consequently this mitigates or eliminates the risk of insufficient local heat exchange. The greater the angle of baffles slope (α), the greater the action of detachment and upwards outflow of vapor from the lower surface (15); however, the greater the angle of slope (α) and the lower the deviating effect of the baffles (12,17,18,20,21) and therefore the lower the mixing action of liquid and vapor phase. Consequently, as an expert in the field can understand, the angle of slope (α) will have an optimum depending on operating conditions of the vertical vapor generator (G1,G2,G3,G4).

Shell-side fluid (F1) may contain impurities, such as salts, metal oxides and debris, which by gravity tend to settle on the upper surface of the baffles (16), especially when shell-side fluid (F1) has a low velocity or the shell (5) is emptied. According to an aspect of the present invention, the slope of single-segment, multi-segment and cone and truncated cone baffles (12,17,18,20,21) does not promote the deposit of impurities on the upper surface of the baffles (16); specifically, the configuration of the baffles (12,17,18,20,21) makes the impurities settle on a sloped surface, rather than horizontal, and then flow downwards and do not accumulate on the baffles. Mainly, the configuration of the baffles (12,17,18,20,21) allows the shell-side fluid (F1) to have a downwardly-directed vertical flow component on the upper surface of the baffles (16) during shell washing and/or emptying. This allows to carry out an effective cleaning action of the baffles and therefore to mitigate or eliminate the fouling formation and growth on the upper surface (16) of the baffles (12,17,18,20,21), with consequent mitigation or elimination of the risk of insufficient local heat exchange. The passages or slots (23,29) installed on single-segment (12), multi-segment (17,18) and cone and truncated cone (20,21) baffles are designed to ease the downward flow of impurities that can accumulate on the upper surface (16) of the baffles (12,17,18,20,21). The impurities that drain downwards can be permanently removed from shell-side by blowdowns or drains placed in the lower part of the tube-bundle.

As one of ordinary skill in the field can easily understand, other embodiments, such as the following, are contemplated:

- Single-segment, multi-segment, and cone-truncated cone baffles (12,17,18,20,21) may have different slope angles (α) along the longitudinal axis (1). For example, the baffle next to a tube-sheet (3,4) may have a slope angle (α1) smaller than the slope angle (α2) of the other baffles. For example, the slope (α) can upwardly increase, with the increase of the vapor fraction;
- The tube-side fluid (F2) can flow by two or more passes in the straight exchanging tubes (2). For example, the tube-side fluid (F2) can enter the vertical vapor generator (G1,G2,G3) from the tube-side distributor located at the bottom (6), make two passes in the straight exchanging tubes (2) and exit the vertical vapor generator from the tube-side distributor located at the bottom (6);
- The vertical vapor generator may include bayonet type exchanging tubes (2) with free ends placed at the top or bottom;
- The vertical vapor generator can have a slight slope with respect to the ground (30), of about 10 degrees at most, i.e. have the longitudinal axis (1) slightly sloped;
- Shell-side fluid (F1) can enter the vertical vapor generator with a fraction of vapor, and can exit the vertical vapor generator with a vaporization of 100%;
- Shell-side fluid (F1) can move upwards by natural, assisted or forced circulation;
- The exchanging tubes (2) can be filled with a chemical catalyst to conduct exothermic chemical reactions within the tube-side fluid (F2).

It should be noted that for some vertical vapor generators it may be sufficient to have only a few sloped baffles. For example, in tube-bundle areas where the temperature of the tube-side fluid is low or moderate, the shell-side baffles can be horizontal. Consequently, it is emphasized that the vertical vapor generator can have both sloped baffles, as disclosed herein, and horizontal baffles. However, as one of ordinary skill in the field can understand, even when the temperature of the tube-side fluid is not high, accumulation of vapor under the baffles and accumulation of impurities above the baffles can anyway lead to corrosion problems or reduced heat exchange.

The single-segment, multi-segment or cone and truncated cone baffles (12,17,18,20,21) can be anchored by means of different devices, such as tie-rods connected to the tube-sheets or supports connected to the shell.

From the above, in aspects, the present invention provides for a vertical vapor generator of shell-and-tube type, with boiling shell-side fluid with ascending flow, where the operating conditions near the lower and upper surface of the baffles are improved. More precisely, in aspects, the present invention provides for a transfer-line heat exchanger for ethylene plants, a process boiler or a boiling water-cooled tubular chemical reactor that are operationally more reliable in case of high vaporizations and/or in case of low water velocities, and that are less sensitive to the presence of impurities in the water. Higher reliability and longer operating life are achieved with a solution that is technologically simple and efficient, and relatively easy to implement.

In aspects, the present invention provides an operating method for vertical vapor generators, with boiling shell-side fluid and ascending flow, including single-segment, multi-segment or cone and truncated cone baffles (12,17,18,20,21) as per this invention. The operating method refers the outflow of the shell-side fluid (F1) across the tube-bundle; in particular, the operating method refers the outflow of the shell-side fluid (F1) on the lower surface (15) of the baffles (12,17,18,20,21), being characterized by a vertical upward flow component promoting the removal of vapor pockets or bubbles. The operating method includes following operations:

- The introduction of the shell-side fluid (F1) in the lower part of the tube-bundle;
- The substantially two-dimensional outflow of the shell-side fluid (F1) across the tube-bundle, from bottom to top;
- The indirect heat transfer from the tube-side fluid and/or solid (F2) to shell-side fluid (F1) and the consequent boiling of shell-side fluid (F1);
- The outflow of vapor from the lower surface (15) of the baffles (12,17,18,20,21) through a shell-side flow characterized by a vertical upward flow component, limiting or eliminating vapor accumulation;

The downward outflow of impurities accumulated by gravity from the upper surface (16) of the baffles (12,17,18,20,21) to limit or eliminate the fouling growth;

The extraction of the shell-side fluid (F1) from the top of the tube-bundle with a fraction of vapor higher than the inlet fraction.

The vertical vapor generator of this invention, as conceived and described, is subjected in any case to numerous modifications and variants, all attributable to the same inventive concept. In addition, all details can be replaced with technically equivalent elements. In practice, construction materials, shapes and sizes, can be of any type according to technical requirements.

The relevant contents of each reference, publication and patent cited herein are hereby incorporated by reference.

The invention claimed is:

1. Vertical shell-and-tube vapor generator (G1,G2,G3, G4), with substantially cylindrical geometry and longitudinal axis (1) orthogonal to a horizontal ground (30), for indirect heat exchange between a tube-side fluid (F2) to be cooled and a shell-side fluid (F1) to be vaporized, the generator configured for the shell-side fluid having ascending flow, comprising:

at least one tube-sheet (3,4) parallel to the ground (30) and provided with a plurality of bores, a plurality of exchanging tubes (2) connected to said bores and forming a tube-bundle, a shell (5) enveloping said tube-bundle, a tube-side distributor (6,7) connected to said tube-sheet (3,4) on a side of said tube-sheet opposite said tube-bundle and in fluid communication with said exchanging tubes (2), inlet and outlet shell-side connections (10,11) on said shell (5) for introducing and extracting said shell-side fluid (F1) respectively at a bottom and from a top of the tube-bundle, inlet and outlet tube-side connections (10,11) on said tube-side distributor (6,7) for introducing and extracting said tube-side fluid (F2) respectively, a set of shell-side baffles intersecting at least portions of said exchanging tubes (2) to support said exchanging tubes (3) and to deviate said ascending flow, wherein each baffle presents at least a symmetry plane containing said longitudinal axis (1) so to develop on shell-side a substantially two-dimensional flow, wherein said baffles are staggered and/or alternate along said longitudinal axis (1), wherein said baffles have a lower and an upper surface (15,16) and have either only a first portion of perimeter or a first and a second portion of perimeter, wherein said first portion of perimeter crosses the tube-bundle and said second portion of perimeter at least partially circumscribes the tube-bundle, wherein said first portion of perimeter forms a cut corresponding to an opening for the passage of said shell-side fluid (F1), wherein one or more baffles (12,17,18,20,21) of said set form an angle ($\alpha$) relative to the ground (30) so to be sloped and have said first portion of perimeter (14,31,33) that lays on a plane orthogonal to the longitudinal axis (1) and that is upwardly facing so to correspond to the top of said sloped baffles (12,17,18,20,21), wherein said sloped baffles (12,17,18,20,21) develop on the lower surface (15) a vertical and upward component of the shell-side flow to promote a detachment and upward outflow of vapor pockets and bubbles and to promote on the upper surface (16) a detachment and downward outflow of deposits accumulated by gravity.

2. Vertical vapor generator (G1,G4) according to claim 1, wherein said sloped baffles are single-segmental (12), equivalent to elliptical segments having a chord (14) and an arc (13) respectively corresponding to said first and second portion of perimeter.

3. Vertical vapor generator (G2,G4) according to claim 1, wherein said sloped baffles are multi-segmental (17,18) and comprise lateral segments (17) equivalent to elliptical segments arranged in pairs and central segments (18) equivalent to double-sided elliptical segments crossed or not crossed by the longitudinal axis (1) arranged either in pairs or individually, wherein said pairs of segments or individual segments (17,18) are symmetric relative to two planes each other orthogonal and containing the longitudinal axis (1), wherein said multi-segmental sloped baffles (17,18) have chords (14) and arcs (13) respectively corresponding to said first and second portion of perimeter, and wherein said central segments (18) crossed by the longitudinal axis (1) are shaped so to have a longitudinal section substantially of "V" shape with downward vertex (19).

4. Vertical vapor generator (G3,G4) according to claim 1, wherein said sloped baffles are cones and truncated cones (20,21), substantially corresponding to lateral surfaces respectively of a cone and a truncated cone, wherein said cone and truncated cone sloped baffles (20,21) are axial-symmetric relative to the longitudinal axis (1), wherein said cone sloped baffles (20) have the circular base (33) corresponding to said first portion of perimeter, and wherein said truncated cone sloped baffles (21) have the minor circular base (31) and the major circular base (32) respectively corresponding to said first and second portion of perimeter.

5. Vertical vapor generator (G4) according to claim 1, comprising a shell-side internal wall (35) substantially cylindrical and concentrically arranged relative to said shell (5) and arranged in between said shell (5) and said tube-bundle, forming an annular conduit (40) with said shell (5), and provided with a first and second opening (36,37) respectively at bottom and at top of the tube-bundle.

6. Vertical vapor generator (G1,G2,G3,G4) according to claim 1, wherein said cut (24,25,26,27,28) corresponds to a transversal section approximately in between 15% and 50% of the internal transversal section of said shell (5) or said shell-side internal wall (35).

7. Vertical vapor generator (G1,G2,G3,G4) according to claim 1, wherein said angle ($\alpha$) is in between 0 and 45 degrees.

8. Vertical vapor generator (G1,G2,G3,G4) according to claim 1, wherein said sloped baffles (12,17,18,20,21) form different angles ($\alpha$).

9. Vertical vapor generator (G1,G2,G3,G4) according to claim 1, wherein said sloped baffles (12,17,18,20,21) are provided with slots or passages (23,29) at a lowest portion thereof.

10. Vertical vapor generator (G4) according to claim 1, comprising exchanging tubes having a "U" shape, (2) and one tube-sheet (3) upwardly or downwardly positioned relative to the exchanging tubes (2).

11. Vertical vapor generator according to claim 1, comprising bayonet exchanging tubes (2) and two tube-sheets (3,4) upwardly or downwardly positioned relative to the exchanging tubes (2).

12. Vertical vapor generator (G1,G2,G3) according to claim 1, comprising straight exchanging tubes (2), two tube-sheets (3,4), two tube-side distributors (6,7) each connected to one of said tube-sheets (3,4), wherein one tubesheet (3) is downwardly positioned and the other tube-sheet (4) is upwardly positioned relative to the exchanging tubes (2).

13. Vertical vapor generator (G1,G2,G3,G4) according to claim 1, wherein said boiling shell-side fluid (F1) is high-pressure water that flows under natural, assisted or forced circulation.

14. Operating method for a shell and tube vertical vapor generator (G1,G2,G3,G4), the generator having substantially cylindrical geometry and longitudinal axis (1) orthogonal to the ground (30), for indirect heat exchange between a tube-side fluid (F2) to be cooled and a boiling shell-side fluid (F1) having ascending flow, wherein said vertical vapor generator (G1,G2,G3,G4) comprises:

at least one tube-sheet (3,4) parallel to the ground (30) and provided with a plurality of bores, a plurality of exchanging tubes (2) connected to said bores and forming a tube-bundle, a shell (5) enveloping said tube-bundle, a tube-side distributor (6,7) connected to said tube-sheet (3,4) on a side opposite said tube-bundle and in fluid communication with said exchanging tubes (2), inlet and outlet shell-side connections (10,11) on said shell (5) for introducing and extracting said shell-side fluid (F1) respectively at a bottom and from a top of the tube-bundle, inlet and outlet tube-side connections (10,11) on said tube-side distributor (6,7) for introducing and extracting said tube-side fluid (F2) respectively, a set of shell-side baffles crossed by portions of said exchanging tubes (2) and to support said exchanging tubes (3) and to deviate said ascending flow, wherein each baffle presents at least a symmetry plane containing said longitudinal axis (1), wherein said baffles are staggered and/or alternate along said longitudinal axis (1), wherein said baffles have a lower and an upper surface (15,16) and have either only a first portion of perimeter or a first and a second portion of perimeter, wherein said first portion of perimeter crosses the tube-bundle and said second portion of perimeter at least partially circumscribes the tube-bundle, wherein said first portion of perimeter forms a cut corresponding to an opening for the passage of said shell-side fluid (F1) and wherein one or more baffles (12,17,18,20,21) of said set form an angle ($\alpha$) relative to the ground (30) so to be sloped and have said first portion of perimeter (14,31,33) that lays on a plane orthogonal to the longitudinal axis (1) and that is upwardly facing so to correspond to the top of said sloped baffles (12,17,18,20,21), the method comprising the following steps:

introducing said shell-side fluid (F1) at the bottom of the tube-bundle;

developing an ascending substantially two-dimensional shell-side flow across the tube-bundle;

introducing said tube-side fluid (F2) into the tube-side distributor, and carrying out indirect heat transfer from said tube-side fluid (F2) to said shell-side fluid (F1) to heat and optionally boil said shell-side fluid (F1);

developing on the lower surface (15) of said sloped baffles (12,17,18,20,21) a vertical and upward component of the shell-side flow for promoting the detachment and upward outflow of steam pockets and bubbles from said lower surface (15);

extracting said shell-side fluid (F1) from the top of the tube-bundle to form an extracted shell-side fluid with a higher vapor fraction relative to inlet.

15. Operating method for a vertical vapor generator (G1,G2,G3,G4) according to claim 14, further comprising the detachment and downward outflow, from the upper surface (16) of said sloped baffles (12,17,18,20,21), of deposits accumulated by gravity.

* * * * *